US009733611B2

(12) United States Patent
Iwai

(10) Patent No.: US 9,733,611 B2
(45) Date of Patent: Aug. 15, 2017

(54) IMAGE FORMING APPARATUS

(71) Applicant: CANON KABUSHIKI KAISHA, Tokyo (JP)

(72) Inventor: Hitoshi Iwai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/630,497

(22) Filed: Feb. 24, 2015

(65) Prior Publication Data

US 2015/0241839 A1 Aug. 27, 2015

(30) Foreign Application Priority Data

Feb. 27, 2014 (JP) ..... 2014-037011

(51) Int. Cl.
*B41J 2/165* (2006.01)
*G03G 21/16* (2006.01)
*G03G 15/04* (2006.01)

(52) U.S. Cl.
CPC ..... *G03G 21/1666* (2013.01); *G03G 21/1647* (2013.01); *G03G 15/04072* (2013.01); *G03G 2215/0132* (2013.01)

(58) Field of Classification Search
CPC .... G03G 15/04; G03G 21/16; G03G 15/0409; G03G 15/011; G03G 15/0189; G03G 21/1623; G03G 21/1666; B41J 2/473; B41J 29/04; B41J 29/12; B41J 29/13
USPC ..... 347/117, 138, 170, 233, 242–245, 257, 347/263
See application file for complete search history.

(56) References Cited

U.S. PATENT DOCUMENTS

| | | | | |
|---|---|---|---|---|
| 7,436,426 | B2 * | 10/2008 | Lim | 347/263 |
| 7,872,664 | B2 * | 1/2011 | Yamakawa et al. | 347/241 |
| 8,203,586 | B2 * | 6/2012 | Kaneko et al. | 347/241 |
| 2013/0335790 | A1 * | 12/2013 | Narai | H04N 1/0249 358/497 |
| 2014/0184719 | A1 * | 7/2014 | Aruga | 347/243 |

FOREIGN PATENT DOCUMENTS

JP 2007-148276 A 6/2007

* cited by examiner

*Primary Examiner* — Alejandro Valencia
(74) *Attorney, Agent, or Firm* — Canon U.S.A., Inc. IP Division

(57) ABSTRACT

An image forming apparatus includes a shutter spring engaging with a cover at one end while engaging with a shutter at another end, configured to urge the shutter for a closed state from an open state, a buffer plate supported in a rotatable manner, configured to push the shutter for the open state from the closed state, and a buffer spring held between the buffer plate and the shutter, configured to urge the buffer plate in a direction separating from the shutter. In the image forming apparatus, elastic force of the buffer spring is greater than elastic force of the shutter spring, the buffer plate presses the shutter via the buffer spring, and a length of the buffer spring is greater than a solid height of the buffer spring when the shutter is pushed by the buffer plate to be moved to a position of the open state.

12 Claims, 7 Drawing Sheets

IMAGE FORMING APPARATUS

BACKGROUND

Field of the Invention

The present disclosure relates to an image forming apparatus provided with an optical scanning device having a transparent window for passing a laser beam and a shutter for covering the transparent window for passing the laser beam.

Description of the Related Art

An electro-photographic image forming apparatus, such as a laser beam printer, a digital copying machine and the like, is provided with an optical scanning device for exposing a photosensitive body. The optical scanning device scans a surface of the photosensitive body with a light beam emitted from a semiconductor laser by deflecting the light beam with a rotary polygon mirror. With such an operation, an electrostatic latent image is formed on the surface of the photosensitive body. This electrostatic latent image is developed by adhering toner thereto, so that an image is formed on the recording sheet by transferring the toner image.

In recent years, with popularization of color image forming apparatuses, a so-called tandem system in which a dedicated photosensitive body for each color is provided and an image of each color is formed on an intermediate transfer body at the same time has been considered as the mainstream of the color image forming apparatuses. In the tandem system color image forming apparatus, a so-called four-in-one type optical scanning device in which exposure processing of four colors is executed by a single rotary polygon mirror has been widely used because of its favorable unit size and cost.

Further, from among various four-in-one type optical scanning devices, a so-called lower surface exposure system in which the optical scanning device exposes photosensitive bodies from a side of lower surfaces of the photosensitive bodies has been generally used in order to efficiently use and conserve an internal space of the image forming apparatus. In a case where a process cartridge integrally configured of a photosensitive body and a development unit is detached from or attached to the image forming apparatus provided with the lower surface exposure system optical scanning device in order to execute maintenance and inspection work, toner may be scattered from the process cartridge because of the impact arising from detachment or attachment of the process cartridge. If such scattered objects fall on and adhere to a light emitting window of the optical scanning device, scanning light travelling toward the photosensitive body may be interrupted by the scattered objects and a stripe-like image defect may occur. Therefore, in order to prevent the scattered objects from adhering to the optical scanning device, an opening-closing type dustproof shutter is commonly disposed on an upper portion of the lower surface exposure type optical scanning device. In particular, a flat-plate sliding shutter is commonly used because a space between the photosensitive body and the optical scanning device has limitation. Japanese Patent Application Laid-Open No. 2007-148276 discusses a mechanism for pressing a pair of lever members to open and close a dustproof shutter by using a driving motor and an eccentric cam.

However, with the mechanism for opening and closing the dustproof shutter by using power of the driving motor as discussed in Japanese Patent Application Laid-Open No. 2007-148276, the image forming apparatus is increased in size while the configuration thereof is complicated because a driving motor and a wire harness are disposed thereon.

Further, in the above-described shutter, an opening-closing position of the shutter has to be managed properly. If the opening-closing position thereof is not managed properly, the shutter may interrupt the optical path of the light beam if the shutter is not pushed sufficiently, or the shutter may be damaged by being pushed excessively. In order to solve the above problem, for example, it is necessary to provide a sensor, such as a photo-interrupter, for detecting a terminal position of the shutter, or to dispose a rotation movement mechanism, such as lever members with high precision.

In view of the above mentioned conditions, the present invention is directed to a simple mechanism capable of reliably operating a shutter while ensuring an opening-closing position of the shutter.

SUMMARY

According to an aspect disclosed herein, an image forming apparatus includes a photosensitive body, a light source, a deflection unit configured to deflect a light beam emitted from the light source, an optical member configured to guide the light beam deflected by the deflection unit to the photosensitive body, an optical box configured to store the deflection unit and the optical member, the optical box being provided with the light source, a cover configured to cover an opening of the optical box, the cover having a transparent window for passing the light beam, a shutter configured to move between a first position for retreating from an optical path of the light beam passed through the transparent window and a second position for covering the transparent window, the shutter being disposed at a position between the photosensitive body and the cover, a first spring configured to engage with the cover at one end while engaging with the shutter at another end, the first spring urging the shutter in a direction of the second position from the first position with elastic force, a second spring configured to contact with the shutter at one end, and a pressing unit configured to press another end of the second spring in such a manner that the shutter moves from the second position to the first position.

Further features of the present invention will become apparent from the following description of exemplary embodiments (with reference to the attached drawings).

DESCRIPTION OF THE EMBODIMENTS

Hereinafter, a present exemplary embodiment will be described with reference to the drawings. In the description below, a rotational axis direction of a rotary polygon mirror 203 described below is referred to as a Z axis direction, a main scanning direction (i.e., scanning direction) of a light beam or a lengthwise direction of a reflection mirror is referred to as an X axis direction, and a direction perpendicular to the X axis and the Z axis is referred to as a Y axis direction.

<General Description of Image Forming Apparatus>

Figure 1:
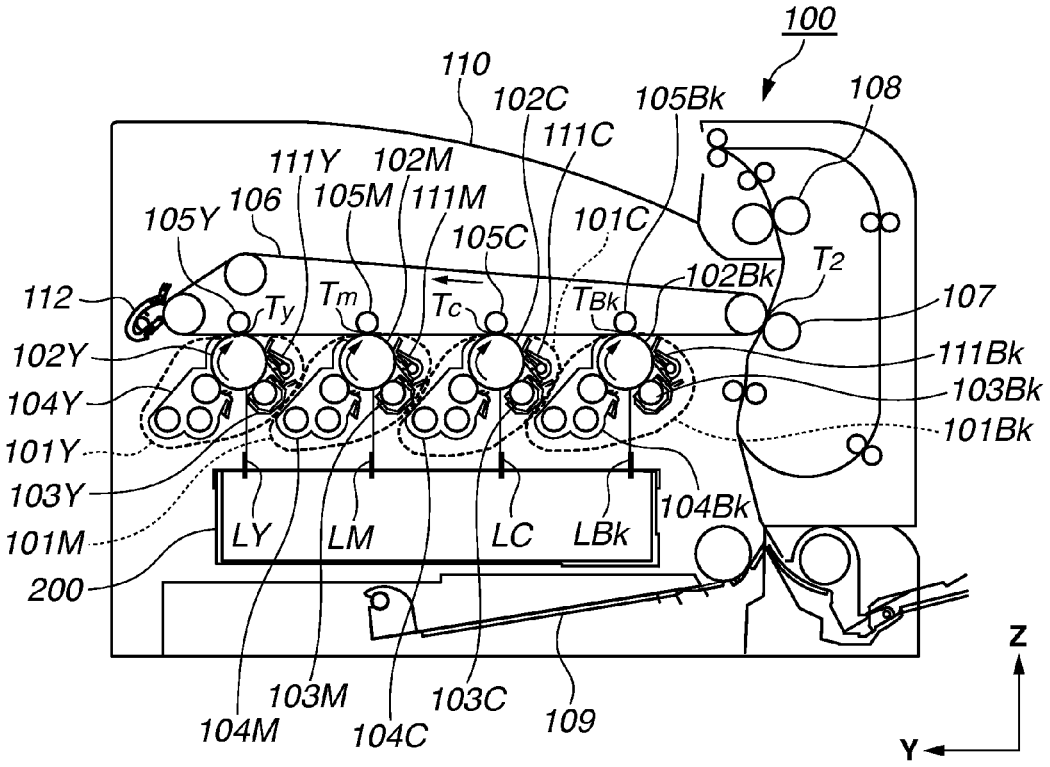
FIG. 1 is a schematic cross-sectional view illustrating an image forming apparatus according to a present exemplary embodiment.

FIG. 1 is a schematic cross-sectional view illustrating an electro-photographic image forming apparatus 100 according to the present exemplary embodiment. The image forming apparatus 100 illustrated in FIG. 1 includes four image forming units 101Y, 101M, 101C, and 101Bk for forming toner images in respective colors of yellow (Y), magenta (M), cyan (C), and black (Bk). Hereinafter, symbols Y, M, C, and Bk which represent the respective colors will be omitted except when necessary. Each of the image forming units 101 includes a photosensitive drum 102 serving as a photosensitive body. Further, each of the image forming units 101 includes a charging device 103 for charging the photosensitive drum 102 and a developing device 104 for developing an electrostatic latent image formed on the photosensitive drum 102 with toner. Each of the image forming units 101 further includes a cleaning device 111 for removing toner left on the photosensitive drum 102 (i.e., surface of photosensitive body) from the photosensitive drum 102.

Each of the image forming units 101 configures a process cartridge integrally configured of the above-described photosensitive drum 102, the charging device 103, the developing device 104, and the cleaning device 111. This process cartridge is a replacement unit detachably attached to the image forming apparatus 100. Hereinafter, the image forming units 101Y, 101M, 101C, and 101Bk are respectively referred to as process cartridges 101Y, 101M, 101C, and 101Bk.

An optical scanning device 200, transfer rollers 105Y, 105M, 105C, 105Bk, an intermediate transfer belt 106, a cleaning unit 112, a sheet feeding unit 109, a sheet discharge portion 110, a transfer roller 107, and a fixing unit 108 are disposed on a main body of the image forming apparatus 100. The optical scanning device 200 is disposed at a lower side with respect to the photosensitive drums 102 in a gravitational direction (−Z axis direction). The optical scanning device 200 may be disposed so as to expose the photosensitive drums 102 from an upper side in a gravitational direction (+Z axis direction).

Image forming processing will be described. The optical scanning device 200 emits light beams LY, LM, LC, and LBk for exposing the photosensitive drums 102Y, 102M, 102C, and 102Bk respectively charged by the charging devices 103Y, 103M, 103C, and 103Bk. The photosensitive drums 102Y, 102M, 102C, and 102Bk are exposed to the light beams LY, LM, LC, and LBk, so that electrostatic latent images are formed thereon.

The developing device 104Y develops the electrostatic latent image formed on the photosensitive drum 102Y with yellow toner. The developing device 104M develops the electrostatic latent image formed on the photosensitive drum 102M with magenta toner. The developing device 104C develops the electrostatic latent image formed on the photosensitive drum 102C with cyan toner. The developing device 104Bk develops the electrostatic latent image formed on the photosensitive drum 102Bk with black toner. A yellow toner image formed on the photosensitive drum 102Y is transferred to the intermediate transfer belt 106 serving as an intermediate transfer body by the transfer roller 105Y at a transfer portion Ty. At a position between the transfer portion Ty and a charging portion of the charging device 103Y in a rotation direction of the photosensitive drum 102Y indicated by an arrow illustrated in FIG. 1 (i.e., clockwise direction), the cleaning device 111Y collects the toner that has not been transferred to the intermediate transfer belt 106 and has been left on the photosensitive drum 102Y.

A magenta toner image formed on the photosensitive drum 102M is transferred to the intermediate transfer belt 106 by the transfer roller 105M at a transfer portion Tm. At a position between the transfer portion Tm and a charging portion of the charging device 103M in a rotation direction of the photosensitive drum 102M, the cleaning device 111M collects the toner that has not been transferred to the intermediate transfer belt 106 and has been left on the photosensitive drum 102M. A cyan toner image formed on the photosensitive drum 102C is transferred to the intermediate transfer belt 106 by the transfer roller 105C at a transfer portion Tc. At a position between the transfer portion Tc and a charging portion of the charging device 103C in a rotation direction of the photosensitive drum 102C, the cleaning device 111C collects the toner that has not been transferred to the intermediate transfer belt 106 and has been left on the photosensitive drum 102C. A black toner image formed on the photosensitive drum 102Bk is transferred to the intermediate transfer belt 106 by the transfer roller 105Bk at a transfer portion TBk. At a position between the transfer portion TBk and a charging portion of the charging device 103Bk in a rotation direction of the photosensitive drum 102Bk, the cleaning device 111Bk collects the toner that has not been transferred to the intermediate transfer belt 106 and has been left on the photosensitive drum 102Bk. The cleaning device 111 according to the present exemplary embodiment is provided with a blade which contacts with the photosensitive drum 102, so that the toner left on the photosensitive drum 102 is scraped and collected by the blade.

The toner images in respective colors transferred to the intermediate transfer belt 106 are transferred to a recording sheet conveyed from the sheet feeding unit 109 by the transfer roller 107 at a transfer portion T2. The toner images transferred to the recording sheet at the transfer portion T2 are fixed by the fixing unit 108, so that the recording sheet is discharged to the sheet discharge portion 110 after the fixing processing.

The image forming apparatus 100 is provided with the cleaning unit 112 disposed at a position between the transfer portion T2 and the transfer portion Ty in a rotation direction of the intermediate transfer belt 106 indicated by an arrow in FIG. 1 (i.e., counter-clockwise direction). The cleaning unit 112 includes a blade which contacts with the intermediate transfer belt 106, so that the toner that has not been transferred to the recording sheet and has been left on the intermediate transfer belt 106 is scraped and cleaned by the blade.

In the configuration according to the present exemplary embodiment described below, the above-described image forming apparatus 100 may be a black-and-white image forming apparatus having a single photosensitive drum, or may be an image forming apparatus directly transferring toner images formed on a plurality of photosensitive drums onto a recording sheet.

<General Description of Optical Scanning Device>

Figure 2A:
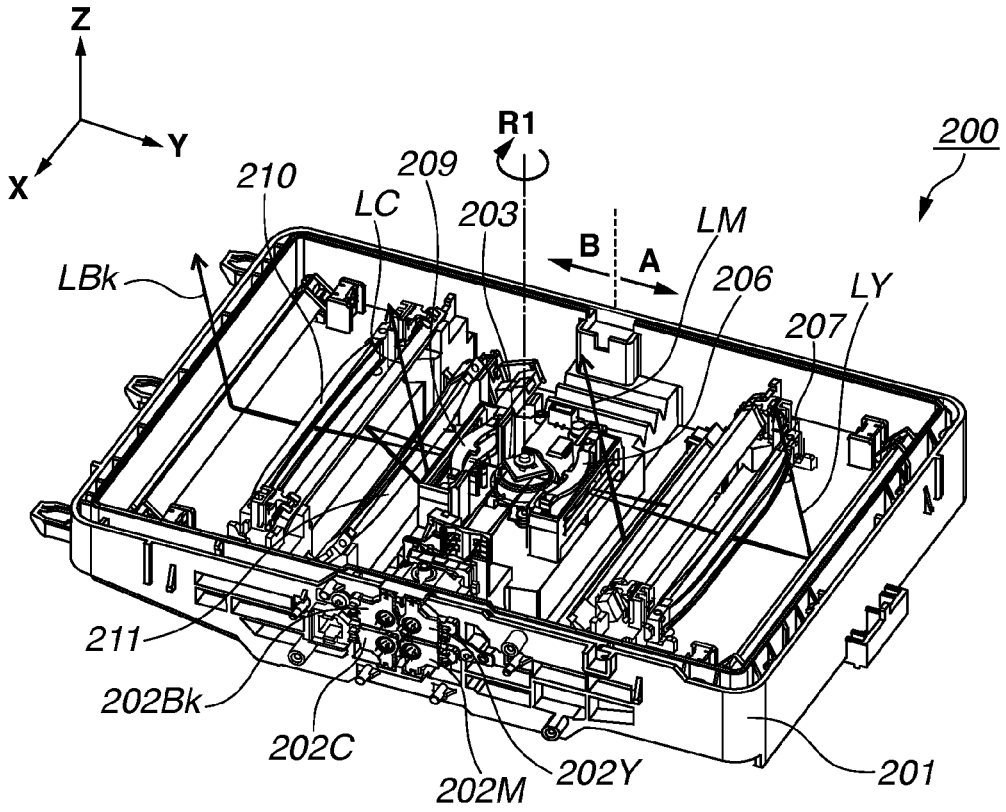
FIG. 2A is a perspective view illustrating a configuration of an optical scanning device according to the present exemplary embodiment.
Figure 2B:
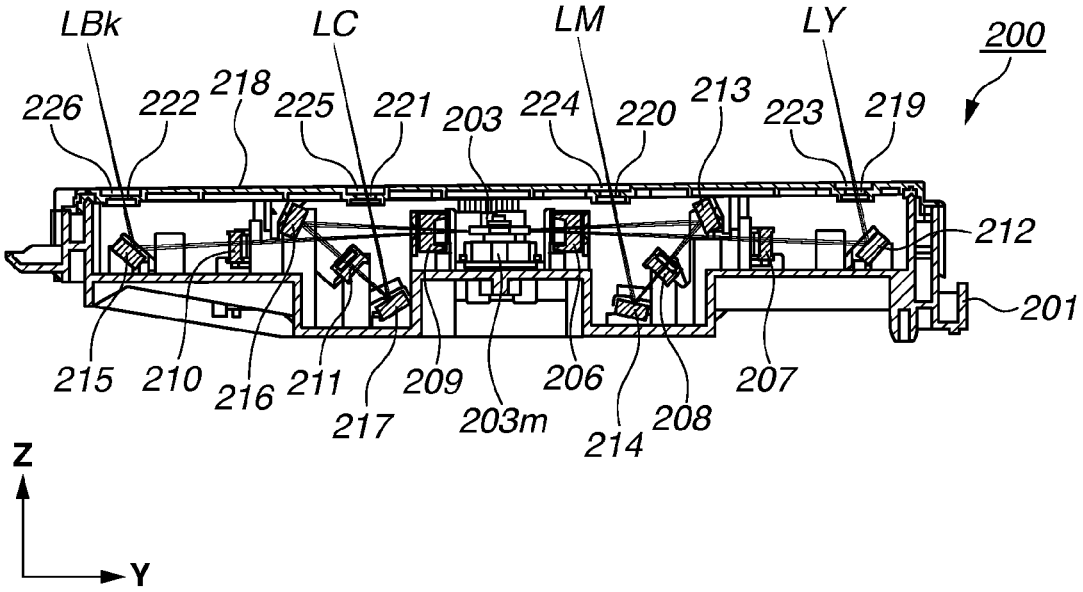
FIG. 2B is a cross-sectional view of the optical scanning device according to the present exemplary embodiment.

The optical scanning device 200 will be described. FIG. 2A is a perspective view illustrating a configuration of the optical scanning device 200. FIG. 2B is a cross-sectional view of the optical scanning device 200. As illustrated in FIG. 2A, light source units 202Y, 202M, 202C, and 202Bk are attached to an exterior wall of an optical box 201 of the optical scanning device 200. The light source unit 202Y emits a light beam LY for exposing the photosensitive drum 102Y, and the light source unit 202M emits a light beam LM for exposing the photosensitive drum 102M. Further, the light source unit 202C emits a light beam LC for exposing the photosensitive drum 102C, and the light source unit 202Bk emits a light beam LBk for exposing the photosensitive drum 102Bk.

The light source units 202Y, 202M, 202C, and 202Bk are disposed adjacent to each other. A plane traversing the rotary polygon mirror 203 by making a rotational axis of the rotary polygon mirror 203 indicated by a dashed-dotted line in FIG. 2A as a normal line is defined as a virtual plane. The light beam LY emitted from the light source unit 202Y and the light beam LBk emitted from the light source unit 202Bk are incident on a reflection plane of the rotary polygon mirror 203 by taking optical paths which obliquely lead from above in a gravitational direction (+Z axis direction) with respect to the virtual plane. On the other hand, the light beam LC emitted from the light source unit 202C and the light beam LM emitted from the light source unit 202M are incident on a reflection plane of the rotary polygon mirror 203 by taking optical paths which obliquely lead from below in a gravitational direction (−Z axis direction) with respect to the above-described virtual plane.

As illustrated in FIG. 2A, the rotary polygon mirror 203 having four reflection planes is disposed at a central portion of the optical box 201. When an image forming operation is executed, the rotary polygon mirror 203 is rotated about the rotational axis indicated by the dashed-dotted line in FIG. 2A in an R1 direction.

The light beam LY emitted from the light source unit 202Y is incident on a reflection plane of the rotary polygon mirror 203. The light beam LY is deflected (reflected) on a side A illustrated in FIG. 2A by the reflection plane of the rotary polygon mirror 203. The light beam LM emitted from the light source unit 202M is incident on the reflection plane of the rotary polygon mirror 203 which is the same reflection plane as the one on which the light beam LY is incident. The light beam LM is deflected on the same side (side A) as that of the light beam LY by the reflection plane of the rotary polygon mirror 203.

On the other hand, the light beam LBk emitted from the light source unit 202Bk is incident on a reflection plane different from the reflection plane on which the light beams LY and LM are incident. The light beam LBk is deflected on a side B illustrated in FIG. 2A by the reflection plane of the rotary polygon mirror 203. The light beam LC emitted from the light source unit 202C is incident on the reflection plane of the rotary polygon mirror 203 which is the same reflection plane as the one on which the light beam LBk is incident. The light beam LC is deflected on the same side (side B) as that of the light beam LBk by the reflection plane of the rotary polygon mirror 203.

The light beams LY and LM deflected by the rotary polygon mirror 203 become light beams travelling in the +X direction. Specifically, by being deflected by the rotary polygon mirror 203 being rotated, the light beam LY becomes the light beam for scanning the photosensitive drum 102Y in the +X direction, and the light beam LM becomes the light beam for scanning the photosensitive drum 102M in the +X direction.

On the other hand, the light beams LBk and LC deflected by the rotary polygon mirror 203 become light beams travelling in the −X direction. Specifically, by being deflected by the rotary polygon mirror 203 being rotated, the light beam LBk becomes the light beam for scanning the photosensitive drum 102Bk in the −X direction, and the light beam LC becomes the light beam for scanning the photosensitive drum 102C in the −X direction.

Optical paths of the light beams LY, LM, LC, and LBk deflected by the rotary polygon mirror 203 will be described with reference to FIG. 2B. As illustrated in FIG. 2B, optical members, such as the rotary polygon mirror 203, lenses 206, 207, 208, 209, 210, 211, and reflection mirrors 212, 213, 214, 215, 216, 217 are stored in the optical box 201. A cover 218 is attached to an opening plane of the optical box 201 on the upper side in order to protect the above-described rotary polygon mirror 203, the lenses 206 to 211, and the reflection mirrors 212 to 217 from dust.

The light beam LY deflected by the rotary polygon mirror 203 is incident on the reflection mirror 212 after passing through the lenses 206 and 207. The reflection mirror 212 reflects the incident light beam LY toward the photosensitive drum 102Y. An opening 219 is formed on the cover 218 in order to pass the light beam LY reflected on the reflection mirror 212. The opening 219 is obstructed by a transparent dustproof window 223 for passing the light beam LY. The light beam LY that has passed through the dustproof window 223 forms an image on the photosensitive drum 102Y.

The light beam LM deflected by the rotary polygon mirror 203 is incident on the reflection mirror 213 after passing through the lens 206. The reflection mirror 213 reflects the incident light beam LM toward the reflection mirror 214. The light beam LM reflected on the reflection mirror 213 is incident on the reflection mirror 214 after passing through the lens 208. The reflection mirror 214 reflects the incident light beam LM toward the photosensitive drum 102M. An opening 220 is formed on the cover 218 in order to pass the light beam LM reflected on the reflection mirror 214. The opening 220 is obstructed by a transparent dustproof window 224 for passing the light beam LM. The light beam LM that has passed through the dustproof window 224 forms an image on the photosensitive drum 102M.

The light beam LBk deflected by the rotary polygon mirror 203 is incident on the reflection mirror 215 after passing through the lenses 209 and 210. The reflection mirror 215 reflects the incident light beam LBk toward the photosensitive drum 102Bk. An opening 222 is formed on the cover 218 in order to pass the light beam LBk reflected on the reflection mirror 215. The opening 222 is obstructed by a transparent dustproof window 226 for passing the light beam LBk. The light beam LBk that has passed through the dustproof window 226 forms an image on the photosensitive drum 102Bk.

The light beam LC deflected by the rotary polygon mirror 203 is incident on the reflection mirror 216 after passing through the lens 209. The reflection mirror 216 reflects the incident light beam LC toward the reflection mirror 217. The light beam LC reflected on the reflection mirror 216 is incident on the reflection mirror 217 after passing through the lens 211. The reflection mirror 217 reflects the incident light beam LC toward the photosensitive drum 102C. An opening 221 is formed on the cover 218 in order to pass the light beam LC reflected on the reflection mirror 217. The opening 221 is obstructed by a transparent dustproof window 225 for passing the light beam LC. The light beam LC that has passed through the dustproof window 225 forms an image on the photosensitive drum 102C.

<General Description of Cover>

Figure 3:
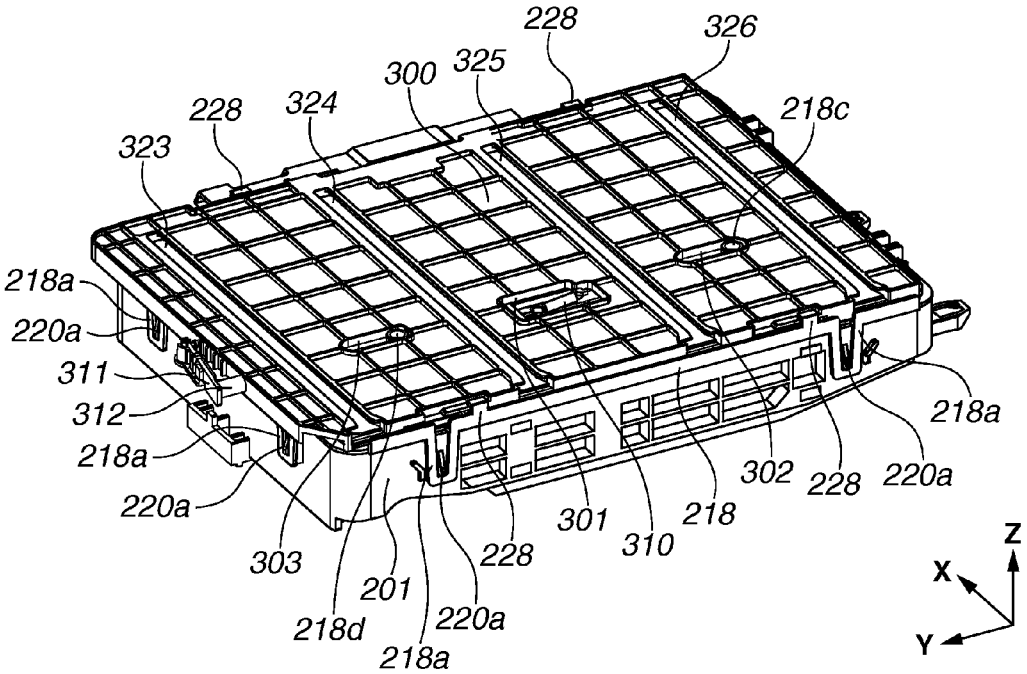
FIG. 3 is a perspective view illustrating an optical box and a shutter according to the present exemplary embodiment.

FIG. 3 is a perspective view illustrating the optical box 201, the cover 218, and the shutter 300 according to the present exemplary embodiment. As illustrated in FIG. 2B, sealing property of an interior portion of the optical box 201 is ensured by the cover 218 attached thereto. As illustrated in FIG. 3, a plurality of hook portions 218*a* is provided on the cover 218. The cover 218 is attached to the optical box 201 by a snap-fit structure in which the plurality of the hook portions 218*a* is each engaged with a plurality of protrusions 220*a* provided on the exterior wall of the optical box 201. The cover 218 is provided with a recess portion 218*b* (described below with reference to FIGS. 4A and 4B) recessed on the inner side of the optical box 201, and projection portions 218*c* and 218*d* respectively serving as a first and a second projection portion projected on the outer side of the optical box 201 (i.e., on the side of the shutter 300).

<General Description of Shutter>

The shutter 300 will be described. The shutter 300 serves as a member for preventing foreign objects, such as toner, from adhering to the dustproof windows 223, 224, 225, and 226 provided on the cover 218 illustrated in FIG. 2B. In a case where a user opens a maintenance door to detach or attach the process cartridge 101 in order to execute the maintenance work of the image forming apparatus 100, toner may be scattered from the process cartridge 101 because of the detachment or attachment of the process cartridge 101. Therefore, at least when the process cartridge 101 is to be replaced, it is desirable that the dustproof windows 223, 224, 225, and 226 of the cover 218 be covered by the shutter 300.

FIG. 3 is a perspective view illustrating a state where the shutter 300 is attached to the optical scanning device 200 in order to cover the cover 218. The shutter 300 is a flat plate-shaped resin member facing the cover 218, and disposed on the upper plane of the cover 218 of the optical scanning device 200. The shutter 300 is guided by guiding projections 228 provided on the cover 218 of the optical scanning device 200 at four places so as not to come off in the upper direction (+Z axis direction), so that the shutter 300 serves as a member for covering the dustproof windows 223, 224, 225, and 226 of the cover 218. The shutter 300 includes an opening 323 for passing the light beam LY that has passed through the dustproof window 223, an opening 324 for passing the light beam LM that has passed through the dustproof window 224, and an opening 325 for passing the light beam LC that has passed through the dustproof window 225. The shutter 300 further includes an opening 326 for passing the light beam LBk that has passed through the dustproof window 226.

Further, an elongate hole 301 is formed on the shutter 300 so that a below-described shutter spring 310 (hereinafter, also referred to as "spring 310"), such as an extension spring serving as an elastic body, is attached thereto. Furthermore, an elongate hole 302 as a first elongate hole and an elongate hole 303 as a second elongate hole are formed on the shutter 300, so that the projection portion 218*c* of the cover 218 is inserted to the elongate hole 302, and the projection portion 218*d* of the cover 218 is inserted to the elongate hole 303. In other words, the elongate holes 302, 303 and projection portions 218*c*, 218*d* as guide bosses configure engagement mechanisms in which the elongate hole 302 engages with the projection portion 218*c* while the elongate hole 303 engages with the projection portion 218*d*, respectively. Because the elongate holes 302 and 303 provided on the shutter 300 are longer in a direction parallel to the Y axis of the shutter 300, the elongate holes 302, 303 and the projection portions 218*c*, 218*d* restrict the movement of the shutter 300 to a reciprocal direction parallel to the Y axis. Therefore, the elongate holes 302, 303 and the projection portions 218*c*, 218*d* function as guiding members for restricting the movement direction of the shutter 300 to the Y axis direction. Further, a buffer plate 311 and a buffer spring 312 which configure a part of the shutter movement mechanism are disposed at an edge portion of the shutter 300.

The spring 310 constantly urges the shutter 300 in a direction for covering the dustproof windows 223, 224, 225, and 226 of the cover 218. Normally, when the image forming processing is executed, the shutter 300 is pushed in a direction for opening the dustproof windows 223, 224, 225, and 226 of the cover 218 by a movement mechanism described below. On the other hand, when the maintenance work is executed, the shutter 300 returns to a position for covering the dustproof windows 223, 224, 225, and 226 of the cover 218. As a result, the shutter 300 prevents scattered objects, such as toner, from adhering to the dustproof windows of the optical scanning device 200 by simultaneously covering the dustproof windows 223, 224, 225, and 226 of the cover 218 corresponding to all the colors of Y, M, C, and K.

Further, according to the present exemplary embodiment, the shutter 300 may be attached to the image forming apparatus 100. Furthermore, the above-described projection portions as the guide bosses may be provided on the shutter 300 while the recess portions (insertion portions) corresponding to the above-described elongate holes may be provided on the cover 218, so that the guiding members are configured by inserting the projection portions provided on the shutter 300 into the recess portions.

<General Description of Shutter Movement Mechanism>

Figure 4A:
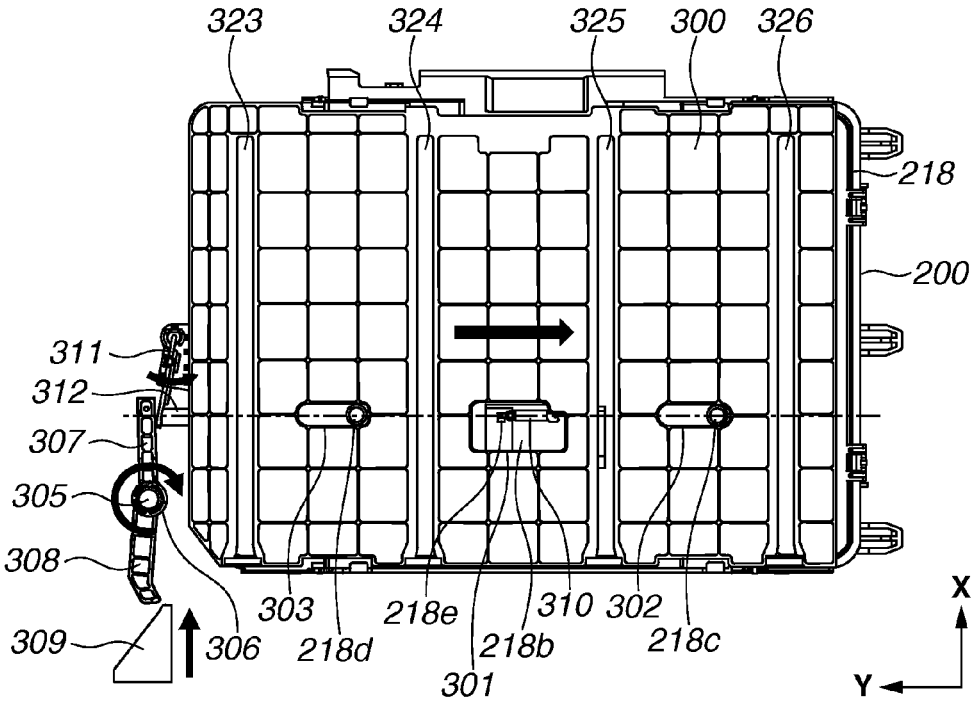
FIGS. 4A and 4B are top plan views respectively illustrating a shutter movement mechanism, the shutter, and the optical scanning device according to the present exemplary embodiment.
Figure 4B:
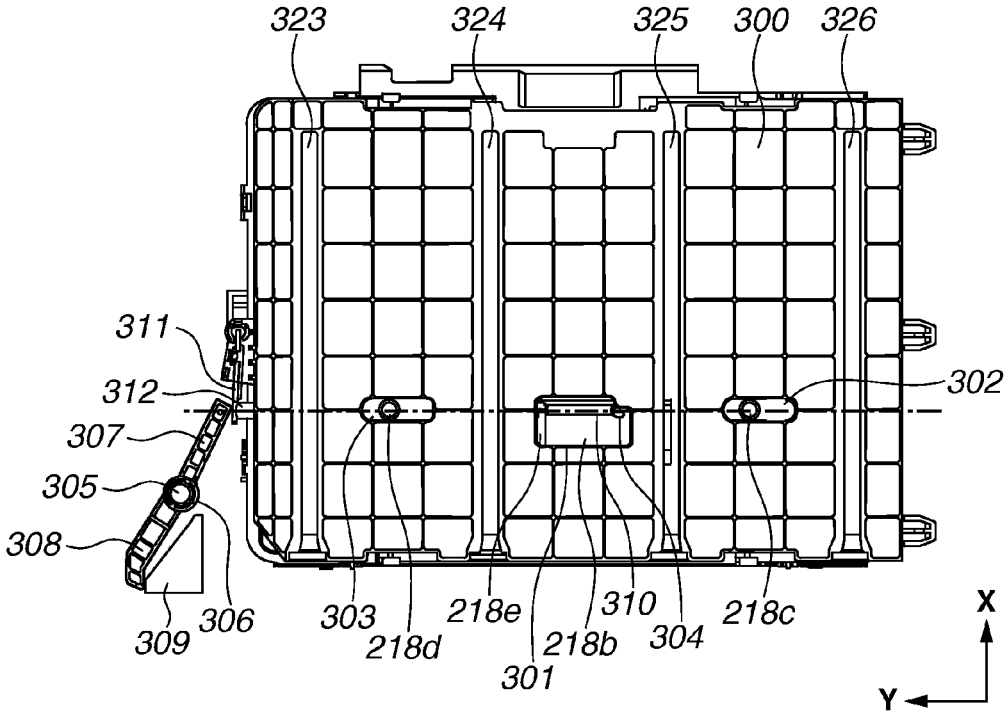

FIGS. 4A and 4B are top plan views of a shutter movement mechanism, the shutter 300, and the optical scanning device 200 seen from above (+Z axis direction). FIG. 4A illustrates a state where the shutter 300 is located in a second position in which the shutter 300 is closed to shield the light beams by covering the dustproof windows 223, 224, 225, and 226 of the cover 218 (i.e., shutter closed state). On the other hand, FIG. 4B illustrates a state where the shutter 300 is opened and located in a retreating position from the optical paths of the light beams. Therefore, in FIG. 4B, the shutter 300 is located in a first position in which the shutter 300 does not cover the dustproof windows 223, 224, 225, and 226 of the cover 218 so that the light beams are not shielded by the shutter 300 (i.e., shutter open state). In other words, as illustrated in FIG. 4B, when the image forming processing is normally executed, the shutter 300 is pushed in a direction for opening the dustproof windows 223, 224, 225, and 226 of the cover 218 by the shutter movement mechanism described below. On the other hand, when the maintenance work is executed, as illustrated in FIG. 4A, the shutter 300 returns to a position for covering the dustproof windows 223, 224, 225, and 226 of the cover 218 in order to prevent the scattered objects, such as toner, from adhering to the dustproof windows 223, 224, 225, and 226 of the optical scanning device 200.

A rotation movement mechanism configured of a rotary mechanism and the pressing portion 309 is disposed on the image forming apparatus 100 in order to configure a part of the shutter movement mechanism. As illustrated in FIG. 4A, the rotary mechanism is configured of a rotation shaft 305, a rotation portion 306, a lever 307 as a second arm portion, and a lever 308 as a first arm portion. The rotation portion 306, the levers 307 and 308 configure a single rotation member, and the levers 307 and 308 are extended from the rotation portion 306. The rotation member configured of the rotation portion 306 and the levers 307 and 308 is capable of rotating in a clockwise direction as a first direction and a counter-clockwise direction as a second direction that is the opposite direction of the first direction at the rotation shaft 305 as a rotation center.

The buffer plate 311 as a pressing member and the buffer spring 312 as a second spring, which configure a part of the shutter movement mechanism, are disposed at the edge portion of the shutter 300. The buffer plate 311 is supported in a rotatable manner, while the buffer spring 312, such as a compression spring, is held between the edge face of the shutter 300 and the buffer plate 311 to constantly urges the buffer plate 311 in a direction separating from the shutter 300.

The spring 310 as a first spring which configures a part of the shutter movement mechanism will be described. As illustrated in FIG. 4A, an engage portion 218*e* is provided on the recess portion 218*b* of the cover 218 in order to engage with one end of the spring 310, such as a coil spring. On the other hand, as illustrated in FIG. 4B, an engage portion 304 is provided on the shutter 300 in order to engage with another end of the spring 310. In other words, the cover 218 and the shutter 300 are connected to each other by the spring 310, and the spring 310 constantly urges the shutter 300 in a direction for covering the dustproof windows 223, 224, 225, and 226 of the cover 218. According to the present exemplary embodiment, the cover 218 is connected to the shutter 300 by the spring 310. However, the optical box 201 may be connected to the shutter 300.

<Operation of Shutter Movement Mechanism>

Figure 5A:
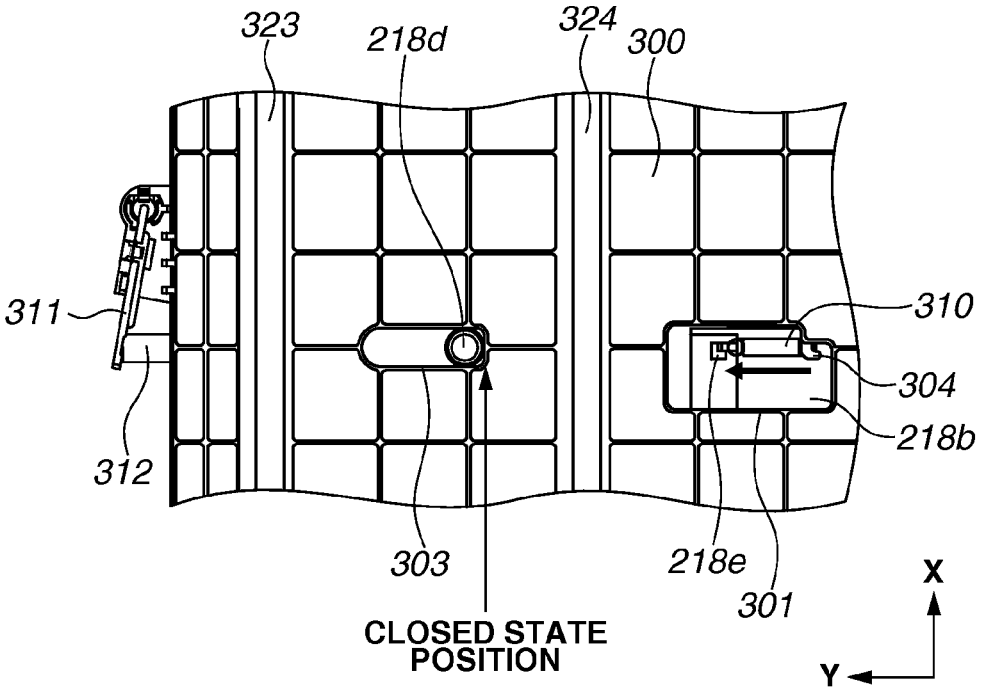
FIGS. 5A and 5B are diagrams respectively illustrating a closed position and an open position of the shutter according to the present exemplary embodiment.

An operation of the shutter movement mechanism (shutter opening-closing mechanism) will be descried with reference to FIGS. 4A and 4B. FIG. 4A is a top plan view of the shutter 300 seen from the above (+Z axis direction), illustrating a state before a toner collection container (not illustrated) is attached to the image forming apparatus 100. The toner collection container is a replacement unit detachably attached to the image forming apparatus 100, and the toner collected from the photosensitive drums 102 by the cleaning device 111 and the toner collected from the intermediate transfer belt 106 by the cleaning unit 112 are contained within the toner collection container. According to the present exemplary embodiment, the shutter 300 is opened or closed in association with the operation for attaching or detaching the toner collection container (not illustrated) to/from the image forming apparatus 100, and in FIG. 4A, the shutter 300 is in a shutter closed state in which the toner collection container is detached from a main body of the image forming apparatus 100. According to the present exemplary embodiment, in the shutter closed state, the spring 310 is contracted and the shutter 300 shields the light beams emitted from the optical scanning device 200 as illustrated in FIG. 4A. Therefore, as illustrated in FIG. 4A, the shutter 300 covers the dustproof windows 223, 224, 225, and 226 provided on the cover 218, so that the light beams LY, LM, LC, and LBk are shielded by the shutter 300 even if these light beams are emitted from the optical scanning device 200. FIG. 5A is a top plan view of the shutter 300 in a shutter closed state seen from the above (+Z axis direction). As illustrated in FIG. 5A, the spring 310 constantly urges the shutter 300 in a direction indicated by an arrow, and the projection portion 218*d* as a guide boss provided on the cover 218 contacts with one end of the wall of the elongate hole 303 provided on the shutter 300, so that the position of the shutter closed state is fixed thereby. Likewise, as illustrated in FIG. 4A, the projection portion 218*c* as a guide boss provided on the cover 218 contacts with one end of the wall of the elongate hole 302 provided on the shutter 300, so that the position of the shutter closed state is fixed although the projection portion 218*c* and the elongate hole 302 are not illustrated in FIG. 5A.

On the other hand, FIG. 4B is a top plan view of the shutter 300 seen from the above (+Z axis direction), illustrating a shutter open state in which the toner collection container (not illustrated) is attached to the image forming apparatus 100. In a case where the toner collection container (not illustrated) is attached to the image forming apparatus 100 at the state illustrated in FIG. 4A, an inclined portion of the pressing portion 309 provided on the toner collection container moves in a direction indicated by an arrow in FIG. 4A, so that the levers 307 and 308 rotate in the clockwise direction indicated by the arrow illustrated in FIG. 4A.

The buffer plate 311 supported in a rotatable manner and the buffer spring 312 held between the edge face of the shutter 300 and the buffer plate 311 are disposed at the edge portion of the shutter 300, while the buffer spring 312 constantly urges the buffer plate 311 in a direction separating from the shutter 300. When the lever 307 is rotated by the pressing portion 309, the buffer plate 311 is pressed to compress the buffer spring 312 in a direction opposite from the urging direction of the buffer spring 312, and thus the buffer plate 311 is urged in a direction for opening the shutter 300.

Figure 6:
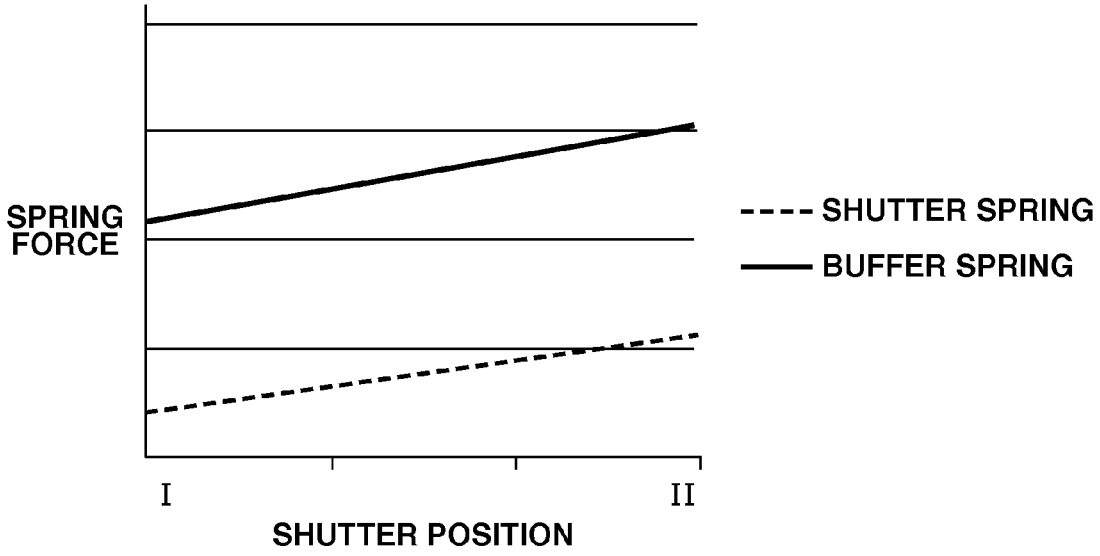
FIG. 6 is a graph for comparing spring force of a shutter spring and a buffer spring according to the present exemplary embodiment.

FIG. 6 is a graph illustrating a relationship between a state of the shutter 300 and urging force (elastic force) corresponding to the spring force of the shutter spring 310 and the buffer spring 312. In FIG. 6, a vertical axis represents the spring force, whereas symbols "I" and "II" on a horizontal axis respectively represent the shutter closed state and the shutter open state of the shutter 300. A spring constant of the buffer spring 312 is larger than a spring constant of the shutter spring 310. As illustrated in FIG. 6, the buffer spring 312 has the urging force (elastic force) greater than that of the shutter spring 310. Further, the urging force of the buffer spring 312 and the shutter spring 310 is greater in the shutter open state than in the shutter closed state because the buffer plate 311 is pressed by the lever 307 when the shutter 300 is in the shutter open state. As described above, the urging force of the shutter spring 310 in a direction of the shutter closed state constantly acts on the shutter 300. As illustrated in FIG. 6, the urging force of the buffer spring 312 is constantly and sufficiently greater than the urging force of the shutter spring 310 throughout the movement of the shutter 300 from the shutter closed state to the shutter open state. Therefore, when the buffer plate 311 is pressed by the lever 307, push-in force of the lever 307 is applied to the shutter 300 via the buffer plate 311 and the buffer spring 312, so that the shutter 300 moves in a direction for the shutter open state. As a result, the spring 310 is stretched, so that the shutter 300 moves in an opening direction indicated by the arrow in FIG. 4A to become the state illustrated in FIG. 4B. According to the present exemplary embodiment, in the shutter open state, the shutter 300 is opened and does not shield the light beams emitted from the optical scanning device 200 as illustrated in FIG. 4B. Therefore, in FIG. 4B, the light beams LY, LM, LC, and LBk can pass through the openings 323, 324, 325, and 326 of the shutter 300 because the shutter 300 does not cover the dustproof windows 223, 224, 225, and 226 provided on the cover 218.

Figure 5B:
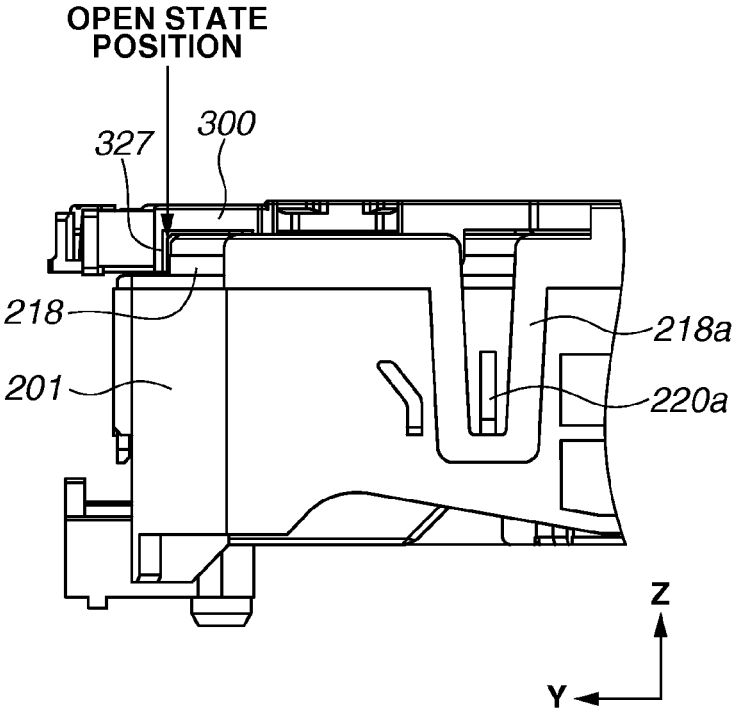

Then, as illustrated in FIG. 5B, the shutter 300 moving in the shutter opening direction stops moving when a protruding portion 327 of the shutter 300 protruded on a side of the cover 218 (cover side) contacts with the edge face of the cover 218. However, the rotation of the lever 307 is still continued at this point of time, and thus the buffer plate 311 is further rotated in a direction for pushing the shutter 300 even though the shutter 300 has stopped moving. Then, the rotation of the lever 307 is stopped when the end portion of the lever 307 has passed the inclined surface of the pressing portion 309. The above-described state is the final open state of the shutter 300 illustrated in FIG. 4B. In order to compensate the insufficient push-in state of the shutter 300 which may occur due to mounting positional variation of the components, such as the lever 307 and the pressing portion 309, arising at the time of assembly, the lever 307 is further rotated after the shutter 300 has stopped moving. The rotation amount of the lever 307 is determined by taking the mounting position variation of each component into consideration.

Further, when the maintenance work is to be executed, the shutter 300 is returned to a cover position (i.e., the state illustrated in FIG. 4A) by the spring 310 because the toner collection container (not illustrated) is always removed and the push-in force caused by the pressing portion 309 is released. Furthermore, the buffer spring 312 urges the buffer plate 311 in a direction separating from the shutter 300. According to the present exemplary embodiment, the pressing portion 309 provided on the toner collection container is used to rotate the levers 307 and 308. This is because the toner collection container is detached or attached before detaching or attaching the process cartridge when the maintenance work is to be executed. Therefore, any operation other than detachment/attachment of the toner collection container may be used to rotate the levers 307 and 308 as long as the operation is executed prior to detachment/attachment of the process cartridge.

<Buffer Spring>

Figure 7A:
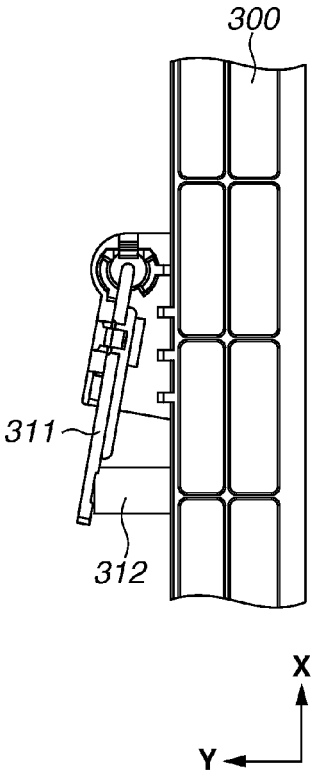
FIGS. 7A, 7B, and 7C are diagrams each illustrating a state of the buffer spring according to the present exemplary embodiment.
Figure 7B:
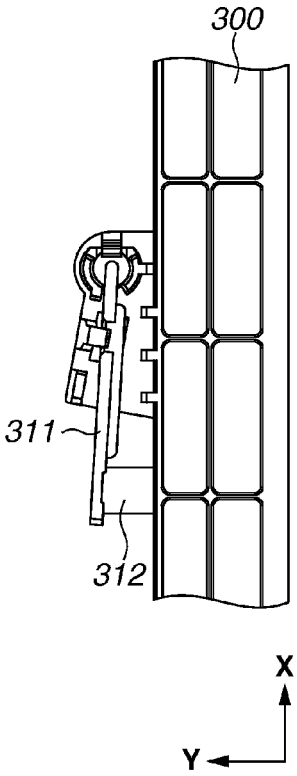
Figure 7C:
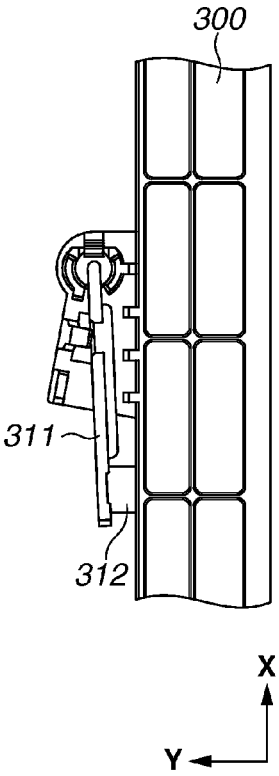

FIG. 7A is a diagram illustrating a state of the buffer plate 311 and the buffer spring 312 when the shutter 300 is in the closed state illustrated in FIG. 4A. FIG. 7B is a diagram illustrating a state of buffer plate 311 and the buffer spring 312 when the shutter 300 is in the open state illustrated in FIG. 4B. FIG. 7C is a diagram illustrating a state where the lever 307 (not illustrated in FIG. 7C) has pressed the buffer plate 311 up to a marginal position of a movable range thereof. A state illustrated in FIG. 7C where the buffer spring 312 has been compressed up to "solid height", i.e., the length at which the buffer spring 312 is compressed up to a point where all the coils thereof are closely and tightly attached to each other. Therefore, as described above, even in a case where the lever 307 has been completely rotated to make the shutter 300 become the open state, the buffer plate 311 is still movable because the buffer spring 312 has not been compressed up to the solid height. As a result, there is no possibility that the shutter movement mechanism or the shutter 300 is damaged due to the reason that the buffer plate 311 or the shutter 300 is excessively pushed by the lever 307.

As described above, by employing a simple rotation movement mechanism in combination with the detachment/attachment operation of the toner collection container disposed on the image forming apparatus main body, the shutter according to the present exemplary embodiment realizes the smooth and reliable shutter opening-closing movement without using a specific driving component, such as a motor. Further, by combining a plurality of springs, variation in mounting positions of the components constituting the rotation movement mechanism can be absorbed. Therefore, the opening-closing operation of the shutter 300 can be executed reliably without using a sensor for detecting the position of the shutter 300 or a high-precision shutter movement mechanism in particular.

Further, the projection portions 218*c* and 218*d* as the guide bosses of the cover 218, an operation point of the lever 307 for pressing the buffer plate 311, and the urging direction of the buffer spring 312 and the shutter spring 310 are aligned on a same straight line indicated by the dashed-dotted lines illustrated in FIGS. 4A and 4B. Therefore, the projection portions 218*c* and 218*d* can smoothly move within the elongate holes 302 and 303 because the opening-closing movement of the shutter 300 becomes linear.

In addition, the toner collection container is always removed when the process cartridge is detached or attached at the time of executing the maintenance work of the image forming apparatus main body. Therefore, when the push-in force of the pressing portion provided on the toner collection container is not applied, the shutter 300 is always returned to a position for covering the dustproof windows 223 to 226 of the cover 218 caused by the urging force of the shutter spring 310.

According to the present exemplary embodiment, the toner collection container is used to rotate the levers 307 and 308. However, any operation other than detachment/attachment of the toner collection container may be used to rotate the levers 307 and 308 as long as the operation is executed at the time of the maintenance work before removing the process cartridge. Further, even if the lever 307 is operated by using the driving force of a motor, a sensor for detecting a position of the shutter or a high-precision shutter movement mechanism is not necessary because the shutter is provided with a buffer mechanism configured of the buffer spring 312 and the shutter spring 310.

As described above, according to the present exemplary embodiment, the shutter can be reliably operated while ensuring the opening-closing position of the shutter by using a simple mechanism.

According to the present invention, a shutter can be reliably operated while ensuring an opening-closing position of the shutter by using a simple mechanism.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-037011 filed Feb. 27, 2014, which is hereby incorporated by reference herein in its entirety.

What is claimed is:

1. An image forming apparatus comprising:

a plurality of photosensitive bodies;

light sources each of which corresponds to one of the plurality of photosensitive bodies;

a deflection unit configured to deflect a plurality of light beams emitted from the light sources;

optical members each of which guides one of the plurality of light beams deflected by the deflection unit to the corresponding photosensitive body;

an optical box configured to store the deflection unit and the optical member, the optical box being provided with the light sources;

a cover configured to cover an opening of the optical box, the cover having a plurality of transparent windows each of which passes one of the plurality of light beams;

a shutter configured to move between a first position for retreating from optical paths of the plurality of light beams passed through the transparent windows and a second position for covering the transparent windows, the shutter being disposed at a position between the photosensitive bodies and the cover;

a first spring configured to engage with the cover at one end of the first spring and configured to engage with the shutter at another end of the first spring, the first spring urging the shutter in a direction of the second position from the first position with elastic force, wherein the first spring is stretched and contracted depending on the position of the shutter between the first position and the second position;

a second spring configured to contact with the shutter at one end of the second spring and of which an elastic coefficient is larger than an elastic coefficient of the first spring, wherein the second spring is stretched and contracted depending on the position of the shutter between the first position and the second position;

a buffer member disposed at another end of the second spring; and a rotating member configured to contract and shrink the second spring via the buffer member by rotating around a rotation axis, the rotation axis being fixed to a main body of the image forming apparatus, wherein the shutter moves from the second position to the first position in a state in which the second spring is pressed by the buffer member which is pressed by the rotating member, wherein the length of the second spring is longer than the solid height of the second spring in a case which the shutter is at the first position.

2. The image forming apparatus according to claim 1, wherein the one end of the second spring contacts with an edge portion of the shutter.

3. The image forming apparatus according to claim 1, wherein the cover includes a first projection portion and a second projection portion projected on a side facing the shutter;

wherein the shutter includes a first elongate hole and a second elongate hole into which the first projection portion and the second projection portion are respectively inserted;

wherein a moving direction of the shutter is restricted to a direction in which the first projection portion and the second projection portion respectively move within the first elongate hole and the second elongate hole.

4. The image forming apparatus according to claim 3, wherein the one end of the first spring engages with the cover at a position between the first projection portion and the second projection portion, and the another end of the first spring engages with the shutter at a position between the first elongate hole and the second elongate hole.

5. The image forming apparatus according to claim 1, wherein the cover includes a first projection portion and a second projection portion projected on a side facing the shutter;

wherein the shutter includes a first elongate hole and a second elongate hole into which the first projection portion and the second projection portion are inserted respectively;

wherein a moving direction of the shutter is restricted to a direction in which the first projection portion and the second projection portion respectively move within the first elongate hole and the second elongate hole, and wherein the first projection portion, the second projection portion, the first elongate hole, the second elongate hole, an engaging portion between the one end of the first spring and the cover, an engaging portion between the another end of the first spring and the shutter, and a portion at which the one end of the second spring presses the shutter are positioned on a same straight line.

6. The image forming apparatus according to claim 3, wherein, when the shutter is positioned at the second position, the first projection portion contacts with an end portion of the first elongate hole, and the second projection portion contacts with an end portion of the second elongate hole positioned on a same side as a side of the end portion of the first elongate hole with which the first projection portion makes contact.

7. An image forming apparatus comprising:

a plurality of photosensitive bodies;

light sources each of which corresponds to one of the plurality of photosensitive bodies;

a deflection unit configured to deflect a plurality of light beams emitted from the light sources;

optical members each of which guides one of the plurality of light beams deflected by the deflection unit to the corresponding photosensitive body;

an optical box configured to store the deflection unit and the optical member, the optical box being provided with the light sources;

a cover configured to cover an opening of the optical box, the cover having a plurality of transparent windows each of which passes one of the plurality of light beams;

a shutter configured to move between a first position for retreating from optical paths of the plurality of light beams passed through the transparent windows and a second position for covering the transparent windows, the shutter being disposed at a position between the photosensitive bodies and the cover;

a first spring configured to engage with the cover at one end of the first spring and configured to engage with the shutter at another end of the first spring, the first spring urging the shutter in a direction of the second position from the first position with elastic force, wherein the first spring is stretched and contracted depending on the position of the shutter between the first position and the second position;

a second spring configured to contact with the shutter at one end of the second spring and of which an elastic coefficient is larger than an elastic coefficient of the first spring, wherein the second spring is stretched and contracted depending on the position of the shutter between the first position and the second position;

a buffer member disposed at another end of the second spring; and a rotating member configured to contract and shrink the second spring via the buffer member by rotating around a rotation axis, the rotation axis being fixed to a main body of the image forming apparatus, wherein the shutter moves from the second position to the first position in a state in which the second spring is pressed by the buffer member which is pressed by the rotating member.

8. The image forming apparatus according to claim 7, wherein the one end of the second spring contacts with an edge portion of the shutter.

9. The image forming apparatus according to claim 7, wherein the cover includes a first projection portion and a second projection portion projected on a side facing the shutter;

wherein the shutter includes a first elongate hole and a second elongate hole into which the first projection portion and the second projection portion are respectively inserted;

wherein a moving direction of the shutter is restricted to a direction in which the first projection portion and the second projection portion respectively move within the first elongate hole and the second elongate hole.

10. The image forming apparatus according to claim 9, wherein the one end of the first spring engages with the cover at a position between the first projection portion and the second projection portion, and the another end of the first spring engages with the shutter at a position between the first elongate hole and the second elongate hole.

11. The image forming apparatus according to claim 7, wherein the cover includes a first projection portion and a second projection portion projected on a side facing the shutter;

wherein the shutter includes a first elongate hole and a second elongate hole into which the first projection portion and the second projection portion are inserted respectively;

wherein a moving direction of the shutter is restricted to a direction in which the first projection portion and the second projection portion respectively move within the first elongate hole and the second elongate hole, and wherein the first projection portion, the second projection portion, the first elongate hole, the second elongate hole, an engaging portion between the one end of the first spring and the cover, an engaging portion between the another end of the first spring and the shutter, and a portion at which the one end of the second spring presses the shutter are positioned on a same straight line.

12. The image forming apparatus according to claim 9, wherein, when the shutter is positioned at the second position, the first projection portion contacts with an end portion of the first elongate hole, and the second projection portion contacts with an end portion of the second elongate hole positioned on a same side as a side of the end portion of the first elongate hole with which the first projection portion makes contact.

* * * * *